US006449807B1

(12) United States Patent
Langkammerer

(10) Patent No.: US 6,449,807 B1
(45) Date of Patent: Sep. 17, 2002

(54) TABLE NAPKIN HOLDER

(76) Inventor: Marc Langkammerer, Welserstrasse 72, Nurnberg, 90489 (DE)

( * ) Notice: Subject to any disclaimer, the term of this patent is extended or adjusted under 35 U.S.C. 154(b) by 0 days.

(21) Appl. No.: 09/692,523

(22) Filed: Oct. 19, 2000

(30) Foreign Application Priority Data

Oct. 22, 1999 (DE) ..... 229 18 660

(51) Int. Cl.[7] ..... A44B 21/00; A45F 5/04
(52) U.S. Cl. ..... 24/7; 24/8; 24/9; 24/67.9
(58) Field of Search ..... 24/7, 9, 8, 67.9; D7/631, 634; 221/35, 58

(56) References Cited

U.S. PATENT DOCUMENTS

| | | | | | |
|---|---|---|---|---|---|
| 382,691 | A | * | 5/1888 | Cook | 24/7 |
| 529,186 | A | * | 11/1894 | Pierrepont | 24/8 |
| 542,267 | A | * | 7/1895 | Lepley | 24/7 |
| 715,678 | A | * | 12/1902 | Martin | 24/9 |
| 823,704 | A | * | 6/1906 | Simpson | 24/7 |
| 909,674 | A | * | 1/1909 | Rink | 24/7 |
| 1,390,083 | A | * | 9/1921 | Bowen | 24/7 |
| 2,838,817 | A | * | 6/1958 | Wills | 24/67.9 |
| 4,148,114 | A | * | 4/1979 | Wier | 24/67.9 |
| 5,214,825 | A | * | 6/1993 | Hirzel | 24/67.9 |
| 6,243,925 | B1 | * | 6/2001 | Aszody | 24/7 |

FOREIGN PATENT DOCUMENTS

| | | | | |
|---|---|---|---|---|
| DE | 529 354 | | 7/1931 | |
| DE | 80 09 044 | | 4/1980 | |
| GB | 0019524 | * | 6/1909 | 24/8 |

* cited by examiner

*Primary Examiner*—Victor Sakran
(74) *Attorney, Agent, or Firm*—Merchant & Gould, P.C.

(57) ABSTRACT

A table napkin holder has two bow-like parts for holding a table napkin on an article of clothing. The two bow-like parts are swingable from positions in a common plane in the nonuse state to positions forming an angle with respect to each other in the use state.

11 Claims, 2 Drawing Sheets

TABLE NAPKIN HOLDER

Figure 1:
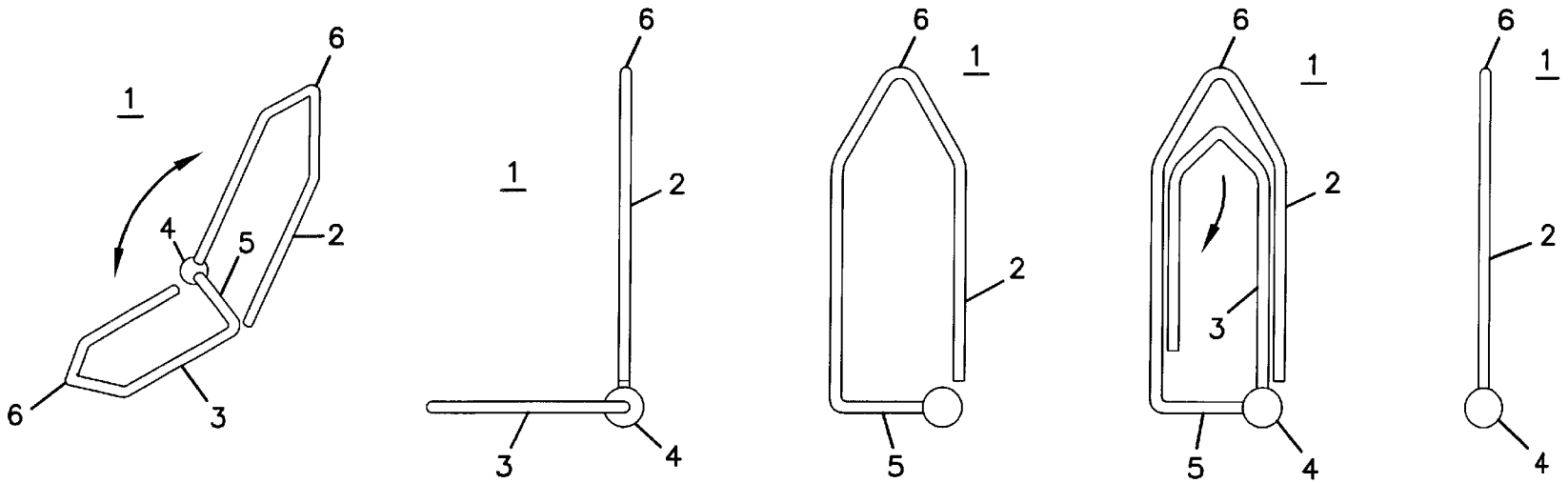

The present innovation relates to a table napkin holder for holding a table napkin to an article of clothing.

DE 529 354 describes a table napkin holder made of wire with a pin for fastening a table napkin to an article of clothing; in this, the table napkin holder consists of an elastic ring, whose ends are formed as hook-shaped pins. The pins overlap each other in such a manner that when the ring is compressed, the points move away from each other, and when the ring is released, the points close again.

The object of the present innovation consists in making available a new kind of table napkin holder that, on the one hand, permits an simple application, and on the other hand can be easily and safely stored.

The present object is accomplished, in a table napkin holder of the generic type, by the fact that the table napkin holder displays two bow-like holding parts that, when in the nonuse state, lie in a common plane, and for the application state are designed to be swingable with respect to each other out of the common plane.

The concept here is to use one of the two bow-like holding parts for holding the table napkin, and to use the other bow-like holding part for fastening the table napkin to a button.

The advantage of the table napkin holder consists in the fact that it displays no pins. Furthermore, the table napkin holder, due to the holding parts' being oriented in a common plane, can be placed into a flat object (e.g. a partition of a wallet or the like) when in the nonuse state, and thus stored in a simple manner. Appropriately, the bow-like holding parts have a U-shape.

A further configuration is characterized by the fact that the two bow-like holding parts differ with respect to their size, so that in the nonuse state the first bow-like holding part surrounds the second bow-like holding part in the common plane.

The bow-like holding parts can, in an especially simple manner, can be realized in the form of wire bows. The table napkin holder according to the present innovation is accordingly also very easy to produce.

For the swinging of the two bow-like holding parts with respect to each other, provision is appropriately made for a hinge, which in addition can be equipped with defined hinge positions and/or engagable hinge positions.

An alternative configuration of the present innovation is characterized by the fact that the two bow-like holding parts are connected via a region of plastic deformation. In this case, it must of course be ensured that a fatigue fracture, due to frequent operation, does not occur.

The point on each bow-like holding part ensures an increased security of holding of the table napkin as well and of the table napkin holder to a button.

Appropriately, the two bow-like holding parts are connected to each other via a common crosspiece, in the region of which the hinge or the region of plastic deformation can also be located.

The bow-like holding parts can be embodied in different materials, e.g. gold, silver, high-grade steel, etc. The form of the napkin holder, with respect to the concrete configuration, offers a multiplicity of possibilities.

Beyond this, the bow-like holding parts can carry settings for precious stones, which due to the shaping of the table napkin holder have an especially good appearance.

Figure 4:
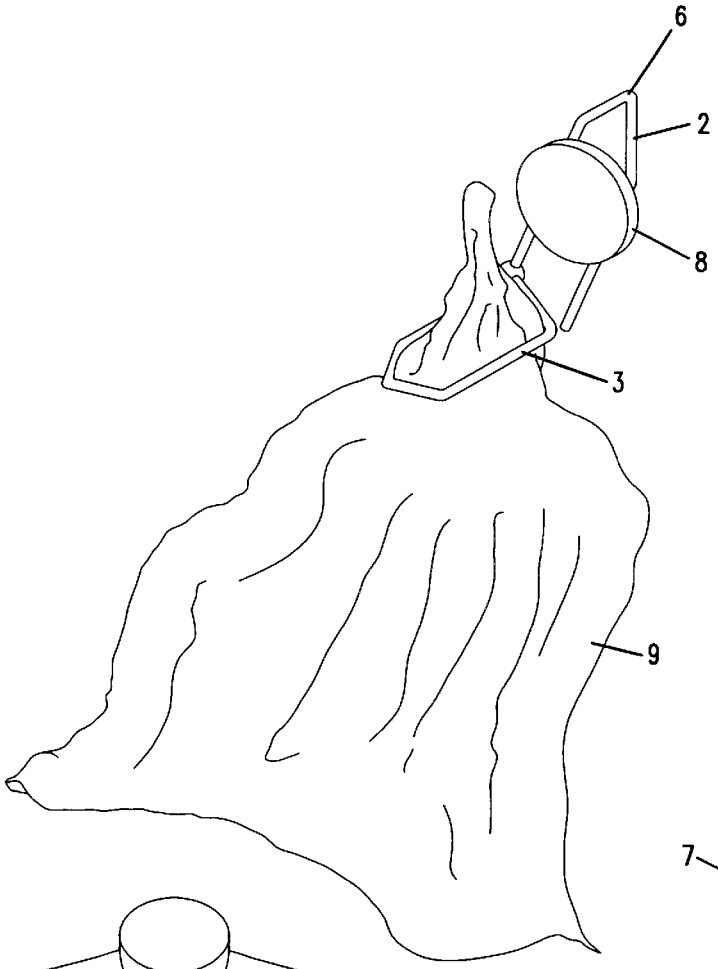
Figure 4:
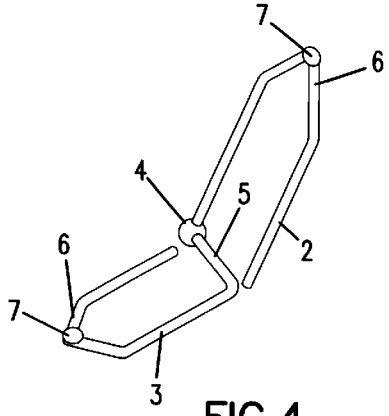
Figure 2:
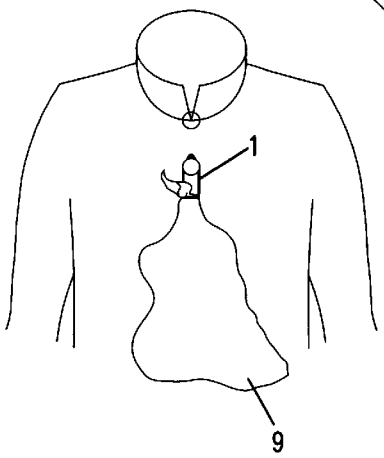
Figure 3:
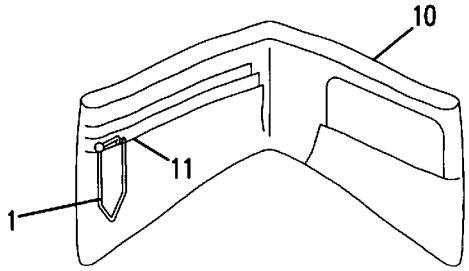

In the following, a particular configuration of the present innovation will be described in detail with the aid of several drawn figures. They show:

FIG. 1: a configuration of the table napkin holder according to the innovation, in different views as well as use positions FIG. 2: a representation of the table napkin holder according to the innovation according to FIG. 1, in use FIG. 3: a representation of the table napkin holder according to the innovation during storage FIG. 4: a representation of the table napkin holder according to the innovation with additionally applied settings for precious stones Reference number 1 in FIG. 1 designates the table napkin holder as a whole. The table napkin holder 1 comprises two bow-like holding parts 2, 3, which in the configuration according to FIG. 1 are realized in the form of wire bows. The two bow-like holding parts 2, 3 are connected to each other via a common crosspiece 5. The first bow-like holding part 2 is larger than the second bow-like holding part 3.

Both bow-like holding parts 2, 3 are swingable with respect to each other, from a nonuse state into a use state, by means of a hinge 4 provided for on the crosspiece 5. In the nonuse state, the two bow-like holding parts 2, 3 lie in a common plane. In the use state, they form an angle with respect to each other, which angle can be predetermined through a catch or defined end position of the hinge 4.

The two bow-like holding parts 2, 3 are in each case formed in a U-shape and possess, in the overlap region between the two legs, a tip 6 of the respective U-shape.

In the two bow-like holding parts 2, 3, in each case one leg is designed somewhat shorter than the opposite leg, whereby the threading of the respective bow-like holding part 2 or 3 onto a button 8 is facilitated.

In the use state (cf. FIG. 2), the table napkin holder 1 is first opened and then fastened to a button 8 by means of one of the two bow-like holding parts 2, 3.

After that, placed into the other bow-like holding part, e.g. 3, is a table napkin 9, either from the underside upwards or from the topside downwards with respect to the bow-like holding part, e.g. 3.

FIG. 3 show the storing of the table napkin holder 1 in a wallet 10. The table napkin holder 1, in its nonuse state with the two bow-like holding pieces 2, 3 located essentially a common plane, is pushed onto a partition 11 of the wallet 10.

The table napkin holder 1, in the region of the bow-like holding parts 2, 3, can be provided with settings 7 (cf. FIG. 4) for receiving precious stones, e.g. diamonds.

The settings 7 are situated, in the embodiment example represented in FIG. 4, in each case in the region of the point 6, since there they are best viewed in the use state.

REFERENCE SYMBOLS

1 table napkin holder
2 holding part
3 holding part
4 hinge
5 crosspiece
6 point
7 setting
8 button
9 table napkin
10 wallet
11 partition

What is claimed is:

1. A table napkin holder for holding a table napkin to an article of clothing, comprising:

first and second bow-like holding parts connected by a hinge, said bow-like holding parts being pivotable with respect to one another such that when said table napkin holder is not in use, said bow-like holding parts are substantially coplanar, and when said table napkin holder is in use said bow-like holding parts are pivoted so as not to be substantially coplanar.

2. A table napkin holder according to claim 1, wherein: said bow-like holding parts are each U-shaped.

3. A table napkin holder according to claim 1, wherein: said first bow-like holding part is larger than said second bow-like holding part, and said first bow-like holding part surrounds said second bow-like holding part in a common plane when said table napkin holder is not in use.

4. A table napkin holder according to claim 1, wherein: said bow-like holding parts comprise wire bows.

5. A table napkin holder according to claim 1, wherein: said hinge has defined hinge positions.

6. A table napkin holder according to claim 1, wherein: said hinge has engagable hinge positions.

7. A table napkin holder according to claim 1, wherein: each bow-like holding part comprises a point.

8. A table napkin holder according to claim 1, wherein: said two bow-like holding parts comprise a common crosspiece.

9. A table napkin holder according to claim 8, wherein: said hinge is disposed proximate said crosspiece.

10. A table napkin holder according to claim 1, wherein: said bow-like holding parts are each comprised of different materials.

11. A table napkin holder according to claim 1, wherein: said bow-like holding parts comprise settings for stones.

* * * * *